US005372734A

United States Patent [19]

Law et al.

[11] Patent Number: 5,372,734

[45] Date of Patent: Dec. 13, 1994

[54] ALKYLATED BENZOTHIOPHENE-DERIVED LUBRICANTS

[75] Inventors: Derek A. Law, Yardley, Pa.; Carleton N. Rowe, Wenonah; Leslie R. Rudnick, Lawrenceville, both of N.J.

[73] Assignee: Mobil Oil Corporation, Fairfax, Va.

[21] Appl. No.: 6,088

[22] Filed: Jan. 19, 1993

Related U.S. Application Data

[63] Continuation-in-part of Ser. No. 701,900, May 17, 1991, abandoned.

[51] Int. Cl.[5] ..... C07D 333/78; C07D 333/72; C10M 105/72; C10M 135/34

[52] U.S. Cl. ..... 252/45; 549/43; 549/49

[58] Field of Search ..... 252/45; 549/43, 49

[56] References Cited

U.S. PATENT DOCUMENTS

| | | | |
|---|---|---|---|
| 2,258,806 | 10/1941 | Pier et al. | 549/49 |
| 2,652,405 | 9/1953 | Conary et al. | 549/49 |
| 4,330,302 | 5/1982 | Taylor | 252/45 |
| 4,427,561 | 1/1984 | Kusayanagi et al. | 252/45 |
| 4,891,448 | 1/1990 | Garces et al. | 585/452 |
| 5,171,915 | 12/1992 | Forbus et al. | 585/455 |
| 5,254,274 | 10/1993 | Ho et al. | 252/45 |

*Primary Examiner*—Jerry D. Johnson
*Attorney, Agent, or Firm*—A. J. McKillop; M. D. Keen

[57] ABSTRACT

Alkylated benzothiophenes or dibenzothiophenes are high-temperature stable lubricant fluids having extreme pressure and antiwear properties, additive solubility and inherent EP/antiwear properties. These novel fluids may also be used as additives in other lubricant fluids.

5 Claims, 1 Drawing Sheet

ALKYLATED BENZOTHIOPHENE-DERIVED LUBRICANTS

CROSS-REFERENCE TO RELATED APPLICATIONS

This application is a continuation-in-part of copending application Ser. No. 07/701,900 filed May 17, 1991, now abandoned.

BACKGROUND OF THE INVENTION

1. Field of the Invention

This invention is directed to improved lubricant compositions comprising monoalkylated benzothiophene-derived compounds alone as functionalized lubricant fluids or in various combinations with synthetic or mineral oil fluids, and to mineral or synthetic lubricant compositions containing said monoalkylated benezothiophene-derived compounds as multifunctional additives thereto.

2. Description of Related Art

Broadly, the novel class of hydrocarbon products of the present invention can be characterized as adducts of a hydrocarbyl substituent precursor, which can contain one or more olefin groups, and a benzothiophene compound.

Polyphenyl sulfides and polyphenyl thioethers are known and have been used as lubricants in special applications. These materials suffer from very high cost due to difficult synthesis and poor low temperature viscometrics.

Polyphenyl ethers are known for their high temperature properties as noted in D. Klamen's "Lubricants and Related Products," Verlag Chemie, 1984, pp. 116–121, and references contained therein, and in product bulletin for OS-124 polyphenyl ether by Monsanto.

Mixed polyphenyl ether-thioethers and polyphenylthioethers are noted in Monsanto bulletin for MCS-293.

Benzothiophene and dibenzothiophene are solids and, therefore, not useful as lubricating fluids in many applications; however, incorporation of linear alkyl hydrocarbon groups into dibenzothiophene eliminates these problems and provides a novel, relatively inexpensive lubricant having excellent antiwear properties. The use of these adducts as a lubricant or lubricant additive in either mineral or synthetic lubricant is unique and provides improved properties and performance benefits due to inherent synergism.

Pier et al., U.S. Pat. No. 2,258,806, is directed to the production of synthetic lubricants "under the influence of condensing catalysts" such as catalysts of the Friedel-Craft reaction.

Kusayanagi et al., U.S. Pat. No. 4,427,561, is directed to lubricant compositions comprising mineral oil, alkylbenzene and added thereto in certain specified amounts an organic sulfur compound. These compositions exhibit high wear resistance in a Flon atmosphere.

Garces, U.S. Pat. No. 4,891,448, is directed to the polyalkylation of polyaromatics in the presence of natural catalytic substances such as mordenite.

Taylor, U.S. Pat. No. 4,330,302, is directed to thermally stable liquid hydrocarbon blends comprising deoxygenated hydrocarbons containing benzothiophenes in amounts of less than about 5 ppm.

Conary et al., U.S. Pat. No. 2,652,405, is directed to a process for the production of aliphatic-substituted thianaphthenes in the presence of a sulfuric acid catalyst.

To the best of applicants' knowledge and belief the herein described alkylated benezothiophene-derived adducts have not been used previously as functional lubricant fluids or additives therefor.

BRIEF SUMMARY OF THE INVENTION

This invention is directed to novel monoalkylated benzothiophene adducts or lubricant fluids thereof having high-temperature stability, excellent additive solubility characteristics and inherent EP/antiwear properties.

The use of these adducts as a lubricant or lubricant additive in either mineral or synthetic lubricants is unique and provides improved properties and performance benefits due to inherent synergism. It is expected that the performance benefits will include antifatigue, antispalling, antistaining, antisquawking, improved additive solubility, improved load carrying/bearing, extreme pressure, improved thermal and oxidative stability, friction reducing, antiwear, anticorrosion, cleanliness improving, low- and high-temperature antioxidant, demulsifying, emulsifying and detergency properties.

It is therefore an object of this invention to provide novel and improved lubricant compositions comprising the benzothiophene compounds in accordance with the invention and novel lubricant compositions containing minor proportions of said monoalkylated benzothiophene compounds as additives. Additionally, the fluids may function as carriers for fuel additives or as fuel cleanliness, detergent, etc. fuel additives.

BRIEF DESCRIPTION OF THE DRAWING

The FIGURE is a GCMS of product in accordance with the invention.

DESCRIPTION OF THE PREFERRED EMBODIMENTS

Figure 1:
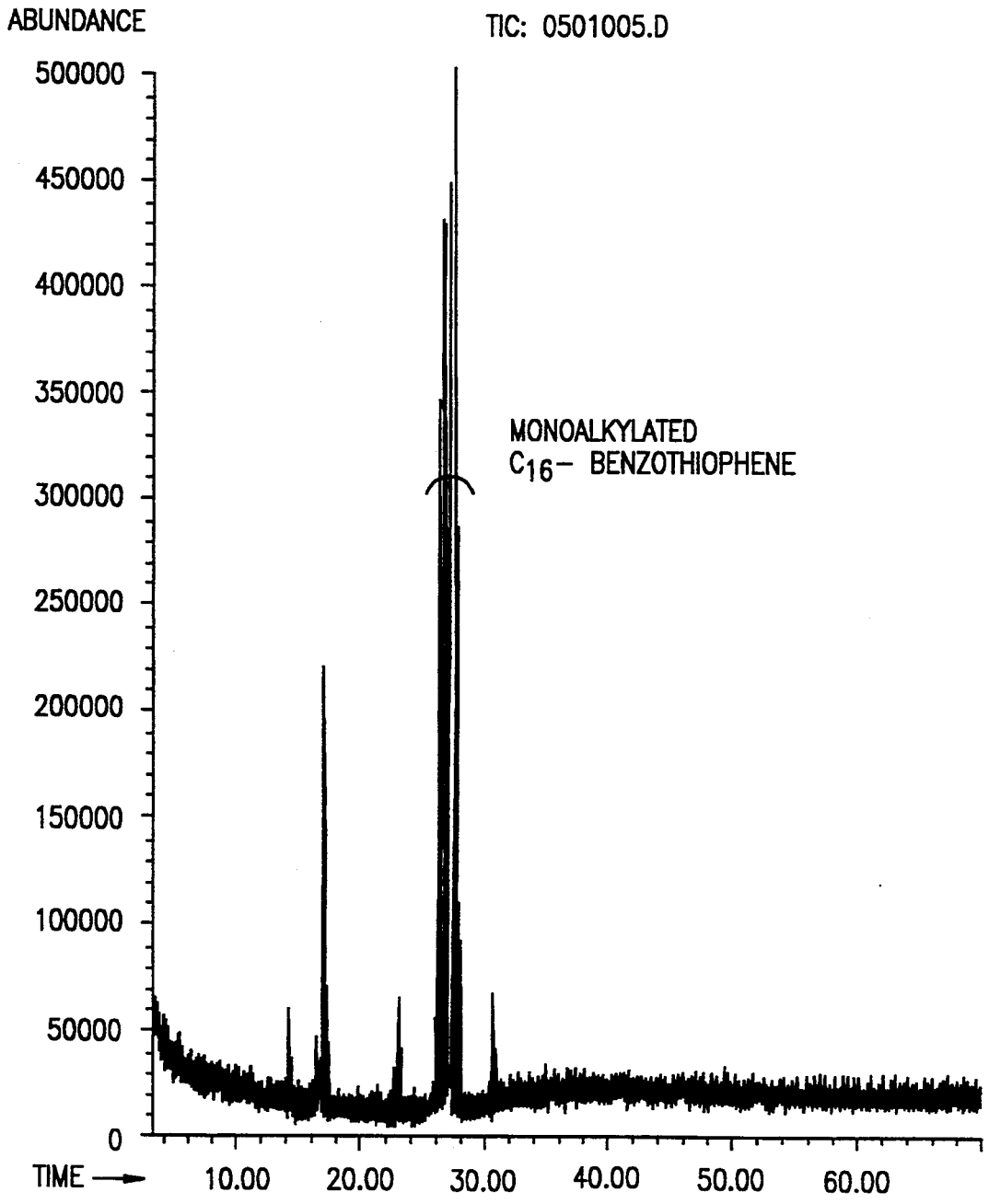

The products obtained from the reaction of a linear olefin and a benzothiophene in the presence of specific zeolite catalysts are unique not only in composition and structure but in utility. Part of the uniqueness is derived from the specific reaction over zeolite catalysts; generally, they have a higher VI at a given viscosity. The incorporation of various monoalkyl groups into the benzothiophene structure provides compositions of different viscosities and low-temperature properties.

Thermal stability of these monoalkylated benzothiophenes and dibenzothiophenes is excellent and believed improved over materials of branched structure due to the facility for carbon-carbon bond breaking in the latter materials.

The FIGURE clearly shows that the product of the alkylation process in accordance with this invention is substantially or almost 100% a monoalkylated product. This is surprising and most unexpected.

These unique lubricants exhibit beneficial properties from the unique reaction of olefin with the benzothiophene structure in such a way as to remain linear. This is a direct result of the catalytic reaction. This combination provides for the novel structural class disclosed herein. The use of these compositions of matter as either functionalized alkylated benzothiophene lubricant fluids or lubricant additives is believed to be novel.

The preparation of the novel compositions in accordance with the invention are by means of a catalytic addition reaction. The exact mechanism of the reaction is not important to the purposes of this invention, so long as the hydrocarbyl group becomes attached to the benzothiophenes described herein, i.e., the benzothiophenes are monoalkylated.

The preferred method of reaction between the hydrocarbyl substituent precursor and the benzothiophene is the combination of these reactants in the presence of specific synthetic zeolite catalysts. The zeolite catalysts should be at least partly in the acidic (H) form to provide the acidity for the reaction. The zeolites may contain other cations also, such as ammonium ($NH_4+$). The zeolite is preferably a large pore zeolite such as the faujasites, e.g., zeolites X, Y, USY, UHP-Y, ZSM-20 or zeolite beta. Another zeolite which may be used is zeolite MCM-22. Zeolite USY is sold commercially as Octacat cracking catalyst. This reaction is affected at temperatures ranging from ambient to 350° C., preferably from 100°-250° C. and most preferably from 180°-240° C. over a period required to produce desired conversion of reactants to product. Optionally, the reaction can be performed in a batch or semi-batch mode by continuous or partial addition of the catalyst or hydrocarbyl group to the thiophene. Catalyst can be used at levels ranging from 1 gram/mole of aromatic to 50 grams/mole of aromatic, preferably 5 grams/mole of aromatic to 50 grams/mole of aromatic, and most preferably from 10-30 grams of catalyst to 1 mole of thiophene.

In general, the product of monoalkylated benzothiophenes is favored by the use of zeolite catalysts such as zeolite beta or zeolite Y preferably USY, of controlled acidity, preferably with an alpha value below about 200 and, for best results, below 100, e.g., about 25-50.

The above preferred method demonstrates the use of the catalysts of choice. MCM-22 is disclosed in U.S. Pat. No. 4,954,325 which is incorporated herein in its entirety by reference. It is also described in U.S. Pat. No. 5,100,534, which is incorporated herein in its entirety by reference, as a crystalline aluminosilicate zeolite. MCM-22 is also described in U.S. Pat. No. 5,103,066 as having a CI (constraint index) of 1.5 at 454° C. U.S. Pat. No. 5,103,066 is incorporated herein by reference.

Constraint Index (CI) values for some typical zeolites are given below.

| | CI (at test temperature) |
|---|---|
| ZSM-5 | 6-8.3 (371° C.-316° C.) |
| ZSM-22 | 7.3 (427° C.) |
| MCM-22 | 1.5 (454° C.) |
| Dealuminized Y | 0.5 (510° C.) |

The method by which Constraint Index of acidic zeolites is determined is described fully in U.S. Pat. No. 4,016,218 incorporated herein by reference for details of the method. The above-described CI is a highly important definition of the zeolites which are useful in the process of the present invention.

The alpha value of the zeolite is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

FCC (fluid catalytic cracking) catalysts based on ultrastable Y type (USY) zeolites are well known in the art to make gasoline having a higher octane number than FCC catalysts based on rare earth exchanged Y (REY) or calcined rare earth exchanged Y(CREY); see U.S. Pat. No. 5,102,530 which is incorporated herein by reference. It is further disclosed in U.S. publication/notice H 449 (Mar. 1, 1988) to Rudesill that the commercially available FCC cracking catalyst (Octacat) comprises about 40% Ultrastable Type X zeolite combined with a silica-alumina sol binder and kaolin matrix and that preferably the USY containing Octacat may comprise from about 15 to about 60 wt. % USY and more preferably from about 35 to about 45 wt. % USY. H 449, filed Jul. 3, 1987, and published Mar. 1, 1988, to Rudesill is incorporated herein by reference.

The hydrocarbon compositions of the present invention relate to improved thermally and oxidatively stable fluids. These may be used optionally as liquid lubricants or as additives in liquid lubricant compositions, and as solid lubricants or in solid lubricant compositions including greases, such a polyurea, lithium carboxylate or clay-thickened greases.

Fuel compositions are also contemplated for use herein. These include both hydrocarbon fuels, including gasoline, naphtha and diesel fuels, or alcoholic fuels or mixtures of alcoholic and hydrocarbon fuels. Fuel compositions can contain 10 to about 10,000 pound of additive per 1000 barrels of fuel or more preferably 25 to 250 pounds per 1000 barrels of fuel.

These hydrocarbon compositions may also be used in combination with prior art additives, for example, antioxidants, EP/antiwear agents, inhibitors, detergents and dispersants, and viscosity index improvers. Non-limiting examples of antioxidants include phenols which can be hindered and aromatic amines.

Non-limiting examples of EP/antiwear additives include zinc phosphorodithioates, sulfurized esters, sulfurized olefins, phosphonates, phosphites, phosphorothionates, etc. Non-limiting examples of inhibitors include DMTD, phenothiazine, etc. Non-limiting examples of detergents and dispersants include sulfonates, phenates, and polymeric succinimides. These can be either metallic or non-metallic. Metallic detergents can be calcium or magnesium derived and can be neutral or over based.

The hydrocarbon compositions of this invention, as mentioned previously above, can be used alone or in combination with other synthetic and/or mineral oil fluids.

When the compositions of the present invention are used in combination with other synthetic and/or mineral oil fluids, the below described oils of lubricating viscosity may be used. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials.

In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

When used as additives the materials in accordance with the invention have the ability to improve both the thermal and oxidative stability as well as the additive solubility of the oleagenous materials, i.e., synthetic and/or mineral oil fluids with which they have been blended.

It is to be understood, however, that the prior art additives disclosed herein are used for their known purposes do not detract from the value of the compositions of this invention, rather these materials enhance the beneficial characteristics of the disclosed alkylated benzothiophene fluids.

Lubricant compositions in accordance with the invention may comprise from less than about 1 to about 100% of the alkylated benzothiophenes of the invention and/or from less than about 100% to about 1% of a synthetic or mineral oil of lubricating viscosity or grease prepared therefrom and from about 0.001 to about 20 wt % of additive material based on the total weight of the composition. However, any suitable blending ratio may be used, for example, a blend of 20% monoalkylated benzothiophene and, for example, 80% PAO has been advantageously used. The benzothiophenes may make up a majority of the blend up to about 80–99+%. The present fluids may therefore be used a replacements for, or as components of, current commercial lubricant formulations. Ester-containing fluids and/or synthetic polyalphaolefins have been found to be highly useful blending agents.

The following examples are exemplary only and are not intended to limit the invention.

EXAMPLE 1

To a vigorously stirred mixture of benzothiophene (134.2 g, 1.0 mole) and 1-hexadecene (224.4 g, 1.0 mole) in a flask fitted with thermocouple and reflux condenser was added 35.8 g of FCC Octacat USY catalyst. The mixture was heated to 200° C. with stirring for six hours. After cooling to room temperature, the mixture was filtered to remove catalyst and vacuum distilled to 170° C. at 0.5–1.5 mmHg to remove unreacted starting materials.

EXAMPLE 2

Using the procedure in Example 1, dibenzothiophene (184.3 g, 1.0 mole) and 1-hexadecene (224.4 g, 1.0 mole) were reacted using 40.9 grams of FCC Octacat USY catalyst.

Typical properties of exemplary hydrocarbyl benzothiophenes are shown in Table 1, below.

TABLE 1

| Aromatic | Benzothiophene | Dibenzothiophene |
|---|---|---|
| Hydrocarbyl | $C_{16}$ | $C_{16}$ |
| KV @ 100° C., cSt | 5.51 | 10.1 |
| VI | 81 | 49 |
| Pour Point (°F.) | −58 | −22 |

EVALUATION OF PRODUCTS

Performance as a Lubricant Having Improved Antiwear

Hexadecene alkylated benzothiophene and dibenzothiophene was compared to a polyolefin base stock in a Four-Ball Wear test. The results show that at higher load, the alkyl benzothiophenes produced less wear than the other base stock, without any adverse effect on coefficient of friction (f).

The antiwear properties of the examples were evaluated using the Four Ball Wear Test as shown in Table 2. The results clearly exhibit the excellent antiwear properties inherent in these unique compositions.

In the Four Ball Test three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 5200 steel for thirty minutes under 40 kg load at 1800 rpm and 200° F. K (as reported in Table 2) the wear coefficient is calculated from the wear volume, V, of the stationary ball. The wear volume is calculated from the wear scar diameter D in mm as follows:

$V=[15,5\ D3-0.001033L]D\times 103$ mm3 where L is the machine load in kg. This equation considers the elastic deformation of the steel balls.

Wear Coefficient K

Dimensionless K is defined as $K=VH/dN$ where

V=wear volume, mm3

H=hardness 9725 kg/mm2 for 52100 steel d=(23.3 mm/rev) (RPH×Time)

N=(0.408) (Load in kg)

If additional information is desired consult test method ASTM D2266 and/or U.S. Pat. No. 4,761,482.

TABLE 2

| FOUR-BALL WEAR TEST RESULTS (200° F./40 Kg/30 min) | 1800 RPM | |
|---|---|---|
| | k | f |
| $C_{16}$ Benzothiophene | 3.8, 5.4 | 0.093 |
| $C_{16}$ Dibenzothiophene | 9.3 | 0.086 |
| Polyolefin base stock | 1300 | 0.09 |

The Four-Ball Wear Test results as noted above clearly demonstrate the excellent antiwear properties of these compositions/fluids.

PERFORMANCE AS A LUBRICANT WITH IMPROVED LOAD CARRYING PROPERTIES

Load-carrying properties were measured using ASTM D2596 at 100° C.

TABLE 3

| | 100° C. | | |
|---|---|---|---|
| | LNS | LWI | Weld |
| Commercial Synthetic Lubricant | 32 | 14.6 | 126 |
| $C_{16}$-Benzothiophene | 50 | 23.4 | 160 |
| $C_{16}$-Dibenzothiophene | 40 | 19.4 | 126 |

PERFORMANCE AS A LUBRICANT WITH IMPROVED ADDITIVE SOLUBILITY

To a PAO synthetic lubricant base stock was added 4.0 wt % of sulfurized isobutylene (as generally described by A. G. Horodysky in U.S. Pat. No. 3,703,504) and 0.5 wt % of a hindered phenolic inhibitor obtained from Ethyl Corp. as Ethyl 702. The mixture of additives was insoluble in the base stock and the sample was cloudy, To this mixture was added 21 wt % $C_{14}$ alkylated benzothiophene, The sample was mixed; the additives completely dissolved and the mixture became clear.

IMPROVED THERMAL STABILITY OF A KIND BENZOTHIOPHENES OVER OTHER LUBRICANT CLASSES

The results of thermal stability tests are shown below:

| Thermal Stability Test | |
|---|---|
| Sample | % Viscosity Change After 72 hrs at 288° C. |
| $C_{16}$-Benzothiophene | −0.93 (at 310° C.) |
| $C_{16}$-Dibenzothiophene | −10.6 (at 310° C.) |
| CSL* | |
| (Sample 1) | −14.8 |
| (Sample 2) | −19.4 |
| (Sample 3) | −38.8 |
| (Sample 4) | −60.9 |
| (Sample 5) | −67.9 |

-continued

| Thermal Stability Test | |
|---|---|
| Sample | % Viscosity Change After 72 hrs at 288° C. |
| Polyol Lubricant Ester | −34.2 |

*Commercial Synthetic Lubricant

The use of alkylated benzothiophenes as a suitable replacement for components of current lubricant formulations is highly desirable. For example, synthetic and/or mineral based lubricant composition containing esters for improved additive solubility would be significantly improved by replacement with alkylated benzothiophenes due to their excellent additive solubility and EP/antiwear properties. Alkylated benzothiophenes prepared as described herein provide excellent base stock properties and could themselves serve as the base stock in formulations for various applications, for example, applications where high temperatures and EP are maintained. Fuel compositions are also contemplated for use herein, these include both hydrocarbon fuels, including gasoline, naphtha and diesel fuels or alcoholic fuels or mixtures of alcoholic and hydrocarbon fuels. Fuel compositions can contain 10 to 1,000 pounds of additive per 1000 barrels of fuel or more preferably 25 to 250 pounds per 1000 barrels of fuel.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. A process for the preparation of a high temperature stable lubricant fluid or lubricant additive comprising catalytically reacting in the presence of a zeolite catalyst having an alpha value below 100 reactants comprising 1) a hydrocarbyl substituent precursor, having a least one olefinic group and optionally containing S, N, O, P, F, or mixtures thereof, and (2) a benzothiophene compound and wherein said hydrocarbyl substituent is selected from the group consisting of alkyl, alkenyl, alkynyl, arylalkyl, alkylaryl or aryl containing from 3 to about 500 carbon atoms wherein the reaction temperature varies from ambient to about 350° C., the molar ratio of hydrocarbyl substituent precursor to benzothiophene compound varies from about 0.5:1.0 to about 10.0:1.0 and the amount of catalyst varies from 1 to about 100 grams of catalyst to about 1 mole of benzothiophene compound and wherein said lubricant fluid or additive is monoalkylated.

2. The process of claim 1 wherein the catalyst is selected from the group consisting of zeolite X, Y, UHP-Y, ZSM-12, ZSM-20, ZSM-22, FCC USY and MCM-22.

3. The process of claim 2 wherein the catalyst is FCC USY.

4. The process of claim 1 wherein the reactants are 1-hexadecene and dibenzothiophene and the catalyst is FCC USY.

5. The process of claim 1 wherein the reactants are 1-hexadecene and benzothiophene and the catalyst is FCC USY.

* * * * *